US006860777B2

(12) United States Patent
Williams et al.

(10) Patent No.: US 6,860,777 B2
(45) Date of Patent: Mar. 1, 2005

(54) RADIATION SHIELDING FOR FIELD EMITTERS

(75) Inventors: Terry N. Williams, Boise, ID (US); J. Brett Rolfson, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/263,490

(22) Filed: Oct. 3, 2002

(65) Prior Publication Data

US 2003/0057861 A1 Mar. 27, 2003

Related U.S. Application Data

(62) Division of application No. 09/483,713, filed on Jan. 14, 2000, now Pat. No. 6,469,436.

(51) Int. Cl.[7] ..... H01J 9/24
(52) U.S. Cl. ..... 445/24
(58) Field of Search ..... 445/24, 25, 50, 445/51; 313/309, 310, 336, 351, 355, 495, 496, 497, 238, 239

(56) References Cited

U.S. PATENT DOCUMENTS

| | | | | |
|---|---|---|---|---|
| 3,500,102 A | 3/1970 | Crost et al. | 313/109 |
| 3,814,968 A | 6/1974 | Nathanson et al. | 313/95 |
| 3,883,760 A | 5/1975 | Cunningham, Jr. | 378/122 |
| 3,970,887 A | 7/1976 | Smith et al. | 313/309 |
| 4,575,765 A | 3/1986 | Hirt | 348/800 |
| 4,859,304 A | 8/1989 | Cathey et al. | 204/298.31 |
| 4,874,981 A | 10/1989 | Spindt | 313/309 |
| 4,940,916 A | 7/1990 | Borel et al. | 313/306 |
| 5,000,208 A | 3/1991 | Ludwig et al. | 134/58 R |
| 5,024,722 A | 6/1991 | Cathey, Jr. | 438/695 |
| 5,049,520 A | 9/1991 | Cathey | 438/443 |
| 5,100,355 A | 3/1992 | Marcus et al. | 445/24 |
| 5,141,461 A | 8/1992 | Nishimura et al. | 445/52 |
| 5,151,061 A | 9/1992 | Sandhu | 445/24 |
| 5,162,704 A | 11/1992 | Kobori et al. | 315/349 |
| 5,186,670 A | 2/1993 | Doan et al. | 445/24 |
| 5,191,217 A | 3/1993 | Kane et al. | 250/423 F |
| 5,199,917 A | 4/1993 | MacDonald et al. | 445/24 |
| 5,205,770 A | 4/1993 | Lowrey et al. | 445/24 |
| 5,210,472 A | 5/1993 | Casper et al. | 315/349 |
| 5,212,426 A | 5/1993 | Kane | 315/169.1 |
| 5,229,331 A | 7/1993 | Doan et al. | 437/228 |
| 5,232,549 A | 8/1993 | Cathey et al. | 456/633 |
| 5,259,799 A | 11/1993 | Doan et al. | 445/24 |
| 5,283,500 A | 2/1994 | Kochanski | 315/169.3 |

(List continued on next page.)

FOREIGN PATENT DOCUMENTS

| | | | |
|---|---|---|---|
| EP | 549133 | 11/1992 | H01J/31/12 |
| GB | 1311406 | 3/1973 | |

*Primary Examiner*—Joseph Williams
(74) *Attorney, Agent, or Firm*—Schwegman, Lundberg, Woessner & Kluth, P.A.

(57) ABSTRACT

Structures and methods are provided for shielding field emitter devices from radiation. In an embodiment, a shielding layer inhibits radiation from degrading field emitter devices while exerting a predetermined force upon the field emitter devices so as to restrain from damaging the structure or affecting performance of the devices. In an embodiment, the field emitter under the protection of the shielding layer sustains structural equilibrium. In an embodiment, the field emitter sustains structural elasticity. In an embodiment, the shielding layer is comprised of tetratantalum boride, which inhibits radiation from degrading field emitter devices while exerting a predetermined force upon the field emitter devices so as to restrain from damaging the structure or affecting performance of the devices. In other embodiments, the field emitter under the protection of the tetratantalum boride layer sustains structural equilibrium or structural elasticity.

52 Claims, 9 Drawing Sheets

U.S. PATENT DOCUMENTS 5,329,207 A 7/1994 Cathey et al. ..... 315/169.1
5,342,477 A 8/1994 Cathey ..... 216/20
5,358,599 A 10/1994 Cathey et al. ..... 438/701
5,358,601 A 10/1994 Cathey ..... 438/721
5,358,908 A 10/1994 Reinberg et al. ..... 437/228
5,372,973 A 12/1994 Doan et al. ..... 437/228
5,374,868 A 12/1994 Tjaden et al. ..... 313/310
5,391,259 A 2/1995 Cathey et al. ..... 156/643
5,438,240 A 8/1995 Cathey et al. ..... 315/169.1
5,448,133 A 9/1995 Ise ..... 313/497
5,451,830 A 9/1995 Huang ..... 313/309
5,620,832 A 4/1997 Sung et al. ..... 430/311
5,621,272 A 4/1997 Levine et al. ..... 313/422
5,632,664 A 5/1997 Scoggan et al. ..... 445/50
5,633,560 A 5/1997 Huang ..... 313/495
5,637,023 A 6/1997 Itoh et al. ..... 445/24
5,643,033 A 7/1997 Gnade et al. ..... 445/24
5,643,817 A 7/1997 Kim et al. ..... 205/124
5,648,698 A 7/1997 Makishima et al. ..... 313/309
5,648,699 A 7/1997 Jin et al. ..... 313/309
5,653,619 A 8/1997 Cloud et al. ..... 445/24
5,801,486 A * 9/1998 Johnson et al. ..... 313/495
5,975,975 A * 11/1999 Hofmann et al. ..... 445/24
6,066,507 A 5/2000 Rolfson et al. ..... 438/20
6,181,060 B1 1/2001 Rolfson ..... 313/495
6,200,182 B1 3/2001 Nanto et al. ..... 445/24
6,236,149 B1 5/2001 Rolfson ..... 313/309
6,252,348 B1 6/2001 Lee ..... 313/495
6,361,392 B2 3/2002 Moradi et al. ..... 445/24
6,369,497 B1 4/2002 Derraa ..... 313/309
6,373,174 B1 4/2002 Talin et al. ..... 313/309
6,417,616 B2 7/2002 Lee ..... 313/495
6,443,788 B2 9/2002 Derraa ..... 445/24
6,559,581 B2 5/2003 Derraa ..... 313/309
6,579,140 B2 6/2003 Derraa ..... 445/24

* cited by examiner

RADIATION SHIELDING FOR FIELD EMITTERS

This application is a Divisional of U.S. application Ser. No. 09/483,713, filed Jan. 14, 2000 now U.S. Pat No. 6,469,436, which is incorporated herein by reference.

FIELD OF THE INVENTION

The present invention relates generally to semiconductor integrated circuits. More particularly, it pertains to systems, structures, and methods to shield a field emitter device from radiation.

BACKGROUND OF THE INVENTION

Interest in field emitter displays is on the rise. This is attributable to the fact that such displays can fulfill the goal of being consumer-affordable hang-on-the-wall flat panel television displays with diagonals in the range of 20 to 60 inches. Certain field emitter displays operate on the same physical principles as cathode ray tube (CRT) based displays. The field emitter releases electrons responsive to the presence of an electromagnetic field. These excited electrons are guided to a phosphor target to create a display. The phosphor then emits photons in the visible spectrum.

The excited electrons also emit photons upon striking the phosphor target. Some of these photons include high-energy radiation phenomena beyond the visible spectrum. Radiation of this kind tends to damage structural materials and diminish the performance of electrical materials, such as semiconductor-based field emitter displays.

To protect field emitter displays from high-energy radiation, tungsten has been used to absorb such radiation. However, field emitter displays that are protected by tungsten continue to experience deterioration. It seems tungsten has added a number of problems of its own. Most of the problems tend toward reliability issues, such as electromigration. These problems suggest that tungsten might be causing deleterious effects upon the physical structure of the field emitter display. Such issues raise questions about the commercial success of the displays in the marketplace. Thus, what is needed are systems, structures, and methods to block radiation while inhibiting the deterioration of field emitter displays.

SUMMARY OF THE INVENTION

The above mentioned problems with field emitter displays and other problems are addressed by the present invention and will be understood by reading and studying the following specification. Structures and methods are described which accord these benefits.

One illustrative embodiment of the present invention includes a field emitter display device. This device has at least one emitter to emit electrons at a desired level of energy, and a shielding layer. The shielding layer inhibits radiation degradation of the at least one emitter. The emitter maintains structural stability in the presence of the shielding layer.

In another illustrative embodiment, a method of forming a field emission device is described. The method includes forming a cathode emitter tip on a substrate, forming an extraction grid, forming a dielectric layer, and forming an opaque layer having a thickness of about 0.5 micron to about 1.0 micron.

These and other embodiments, aspects, advantages, and features of the present invention will be set forth in part in the description which follows, and in part will become apparent to those skilled in the art by reference to the following description of the invention and referenced drawings or by practice of the invention.

DETAILED DESCRIPTION

Figure 1:
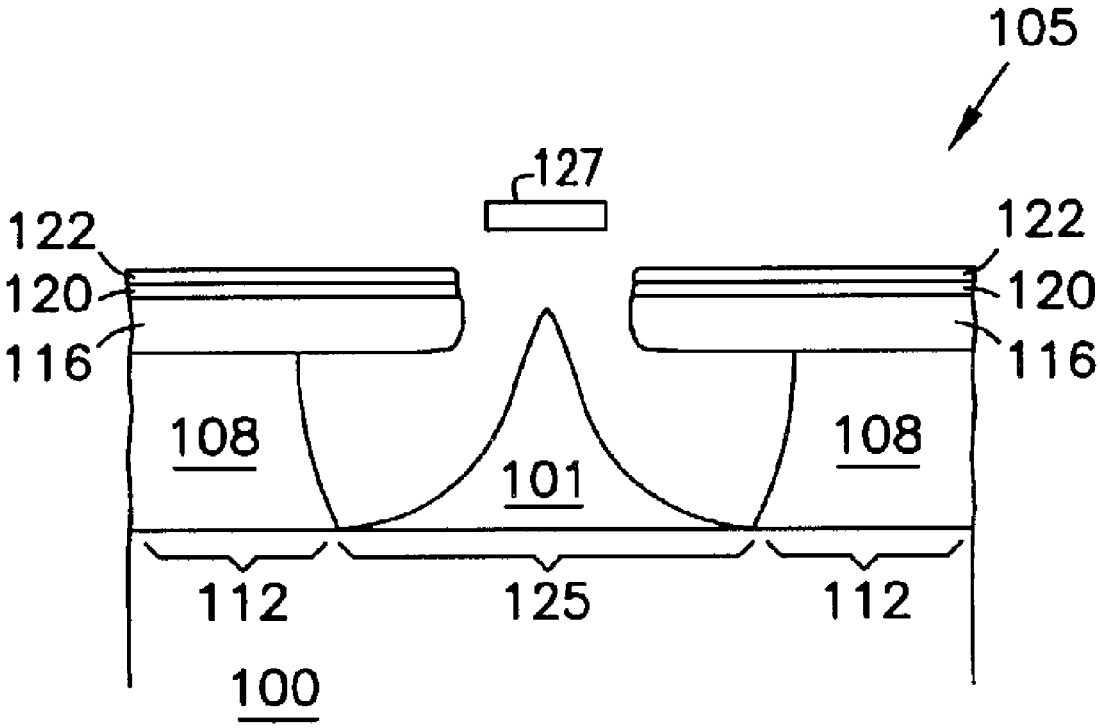
FIG. 1 is an illustration of an emitter tip according to one embodiment of the present invention.

In the following detailed description of the invention, reference is made to the accompanying drawings that form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention.

The terms wafer and substrate used in the following description include any structure having an exposed surface with which to form the integrated circuit (IC) structure of the invention. The term substrate is understood to include semiconductor wafers. The term substrate is also used to refer to semiconductor structures during processing, and may include other layers that have been fabricated thereupon. Both wafer and substrate include doped and undoped semiconductors, epitaxial semiconductor layers supported by a base semiconductor or insulator, as well as other semiconductor structures well known to one skilled in the art. The term conductor is understood to include semiconductors, and the term insulator is defined to include any material that is less electrically conductive than the materials referred to as conductors. The following detailed description is, therefore, not to be taken in a limiting sense, and the scope of the present invention is defined only by the appended claims, along with the full scope of equivalents to which such claims are entitled.

The term "horizontal" as used in this application is defined as a plane parallel to the conventional plane or surface of a wafer or substrate, regardless of the orientation of the wafer or substrate. The term "vertical" refers to a direction perpendicular to the horizontal as defined above. Prepositions, such as "on," "side" (as in "sidewall"), "higher," "lower," "over," and "under" are defined with respect to the conventional plane or surface being on the top surface of the wafer or substrate, regardless of the orientation of the wafer or substrate.

FIG. 1 is an illustration of an emitter tip according to one embodiment of the present invention. A field emitter device 105 includes a substrate 100, a cathode tip 101 formed on the substrate 100, an extraction grid 116, a dielectric layer 120, an opaque layer 122, and a phosphorescent anode 127 in opposing position with respect to the cathode tip 101. The construction of those elements of the field emitter device 105 will be explained below in other figures.

The cathode tip 101 emits electrons in response to the presence of an electromagnetic field. The phosphorescent anode 127 releases photons when the emitted electrons strike the surface of the phosphorescent anode 127. An array of cathode tips 101 and phosphorescent anodes 127 forms the field emitter display. Video images are shown on the display as a result of the input of visual signals being modulated by the array of cathode tips 101 and phosphorescent anodes 127.

The phosphorescent anode 127 is not the only source of photons. As the emitted electrons strike the phosphorescent anode 127, the emitted electrons also release photons. This phenomenon occurs because a photon is composed of electromagnetic energy. When an electron is moving at varying speed, such as acceleration or deceleration, through time and space, it gives off electromagnetic energy. This energy comes together to create matter—photons.

Specifically, when the emitted electrons strike the phosphorescent anode, the emitted electrons begin to slow down and eventually come to rest because of the thick wall of atoms of the phosphorescent anode. Prior to the collision with the wall of atoms, emitted electrons start with a certain quantity of energy and emerge from the collision with a much smaller quantity of energy. However, most of the original energy has not been transferred to the wall. This is the case because this wall is so massive that its recoiling energy is very small. Since the electrons are either slowed down or brought to rest and the wall recoils little, most of the energy emerges as photons.

These emerging photons range from being of very small energy up to high energy radiation beyond the visible spectrum. The high energy radiation includes wavelength in the range of 0.001 Angstrom to 200 Angstroms, which is indicative of the X-ray region of the electromagnetic spectrum. X-rays in the range of 80 Angstroms to 200 Angstroms are known as soft X-rays. X-rays in the range of 0.01 Angstrom to 100 Angstroms are known as hard X-rays. This continuous distribution of X-rays is called bremsstrahlung, which is German for braking, or decelerating, radiation.

The phosphorescent anode 127 is also another source of X-rays. Using the Bohr model for illustrative purposes only, electrons orbit at a number of levels around the nucleus of one of the atoms of the phosphorescent anode. An electronic transition to a level with an orbiting radius closest to the nucleus may emit electromagnetic radiation in the range associated with X-rays. Normally, an atom is stable and the level with the smallest orbiting radius is filled with electrons. Thus other electrons at wider orbiting radii will not transition to the level with the smallest radius. In order for such a transition to occur, an electron from the smaller radius must be removed.

When emitted electrons from cathode tip 101 are bombarding the phosphorescent anode 127, there is a possibility that at least one of the electrons orbiting around the smaller orbit of the nucleus of an atom of the phosphorescent anode 127 will be knocked loose by this bombardment. When this occurs, one of the electrons from the wider orbiting radius will make an electronic transition to fill the smaller orbiting radius. That electronic transition produces photons in the X-ray spectrum. This is discrete X-ray distribution in contrast to the continuous X-ray distribution discussed above.

These types of radiation are some of the sources of radiation near the vicinity of field emitter device 105 that tend to damage its structure and diminish its electronic performance. To protect field emitter devices, tungsten has been used to block high-energy radiation. However, the amount of tungsten needed to protect the field emitter device tends to deform its structure beyond certain conditions, such as structural equilibrium. Structural equilibrium is understood to mean the inclusion of a point that if deformation forces imposing on a structure are removed, the structure will return substantially to its original shape.

Once the structure of the field emitter device is physically deformed beyond these conditions, the electronic properties of the field emitter device may be degraded as well. Over time, the field emitter device may no longer efficiently operate, such as diminishing the ability to emit electrons to create a display.

The mechanics of solids describes how such a deformation can take place. When a layer such as tungsten is placed over certain areas of a field emitter device, the tungsten exerts a force upon these areas underneath it. This force may cause a deformation of these areas. This effect is called stress.

At least three types of stress affect the field emitter device because of the tungsten layer: tensile, shear, and volume. Tensile stress occurs when a force is applied longitudinally to the areas underneath the field emitter device. Shear stress occurs when a force is applied tangentially against a face of the areas while the opposite face is held in a fixed position by a friction force complementary to the tangentially placed force. Volume stress is also known as compressive stress, and it occurs when an external force acts against the areas at right angles to all of the faces. These three types of stress, individually or in combination, may deform the field emitter device to such an extent that its electronic properties are affected.

Another type of stress is induced by radiation striking upon the tungsten layer. The tungsten layer responds to this radiation by becoming unstable and stressing other areas of the field emitter device in the vicinity.

Returning to FIG. 1, an opaque layer 122 is situated on top of the dielectric layer 120. In one embodiment, the opaque layer 122 is a shielding layer. In another embodiment, the opaque layer 122 shields radiation from the field emitter device. In another embodiment, the opaque layer 122 inhibits radiation degradation of the cathode tip 101 while allowing the cathode tip structure to sustain structure stability in one embodiment; structural stability is understood to mean the inclusion of resistance to forces that would degrade structural, electronic, or electrical properties. In yet another embodiment, the opaque layer 122 allows the cathode tip structure to be capable of sustaining structural elasticity; structural elasticity is understood to mean the inclusion of the adaptability of the cathode tip structure to resist reaching beyond the yield point or the breaking point, so as to allow the cathode tip to return to its original shape should the deformation forces be removed. Such resistance is possible because the opaque layer 122 imposes less external forces than a Tungsten layer. Thus, the opaque layer 122 allows the internal forces between the atoms of the material of the cathode tip 101 and the surrounding structure to resist deformation beyond the yield point or the breaking point.

In various embodiments, the opaque layer 122 may be composed of tetratantalum boride, a tungsten rhenium alloy, tungsten nitride, a tantalum-tungsten alloy, a tantalum-germanium alloy, a tantalum-rhenium-germanium alloy, a tantalum-silicon-nitrogen alloy, a tantalum-silicon-boride alloy, or titanium-tantalum alloy. In another embodiment, the opaque layer 122 may be composed of substances that have high atomic number. In another embodiment, the opaque layer 122 is composed of a low-stress-induced substance, compound, or alloy. In all embodiments, the opaque layer 122 is composed of substances, compounds, or alloys that resist the high-energy radiation in the vicinity of the cathode tip 101 while exerting not too great a force to enable the cathode tip 101 to sustain structural stability.

Figure 2:
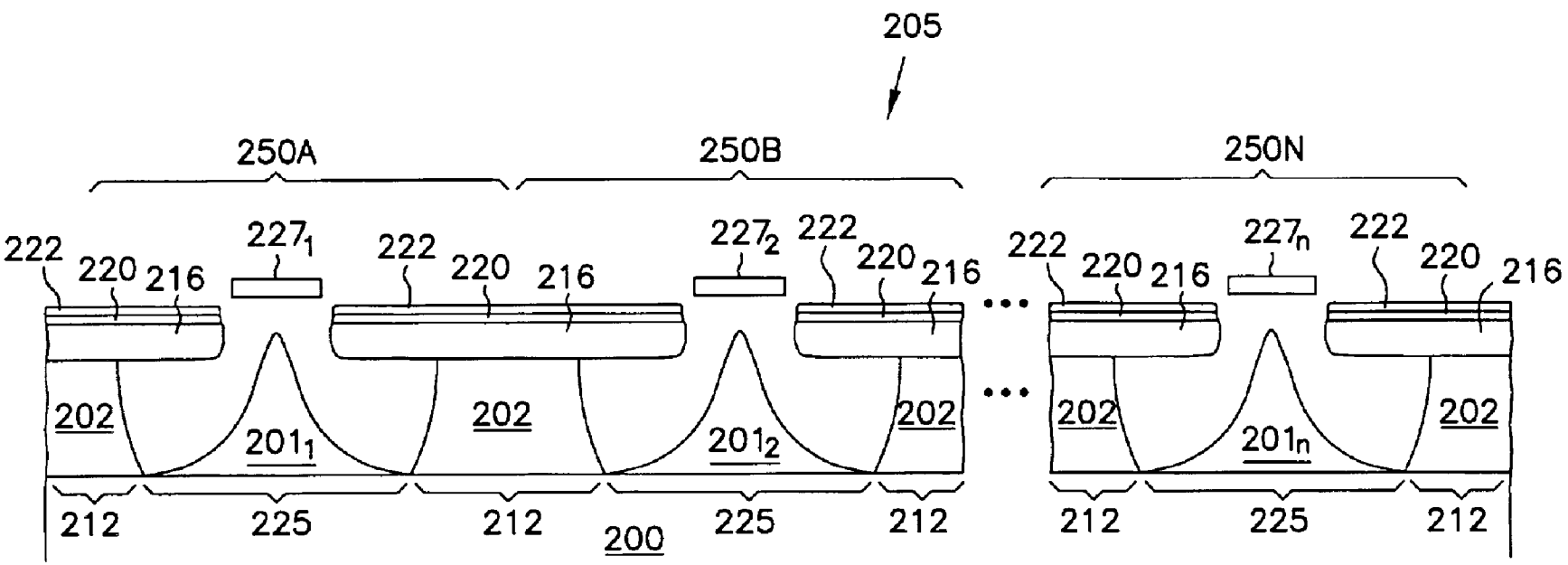
FIG. 2 is a cross-sectional view of a portion of an array of field emitters according to one embodiment of the present invention.

FIG. 2 is a planar view of an embodiment of a portion of an array of field emitter devices including 250A, 250B, . . . , 250N, and constructed according to an embodiment of the present invention. The field emitter array 205 includes a number of cathodes, $\mathbf{201}_1$, $\mathbf{201}_2$, . . . , $\mathbf{201}_n$, formed in rows along a substrate 200. A gate insulator 202 is formed along the substrate 200 and surrounds the cathodes. A number of gate lines are on the gate insulator. A number of anodes including $\mathbf{227}_1$, $\mathbf{227}_2$, . . . , $\mathbf{227}_n$ are formed in columns orthogonal to and opposing the rows of cathodes. In one embodiment, the anodes include multiple phosphors. In another embodiment, the anodes are coated with phosphorescent or luminescent substances or compounds. Additionally, the intersection of the rows and columns forms pixels.

Each field emitter device in the array, 250A, 250B, . . . , 250N, is constructed in a similar manner. Thus, only one field emitter device 250N is described herein in detail. All of the field emitter devices are formed along the surface of a substrate 200. In one embodiment, the substrate includes a doped silicon substrate 200. In an alternate embodiment, the substrate is a glass substrate 200, including silicon dioxide ($SiO_2$). Field emitter device 250N includes a cathode 201 formed in a cathode region 225 of the substrate 200. The cathode 201 includes a cone 201. In various embodiments, the cone 201 may be comprised of silicon, tungsten, or molybdenum.

A gate insulator 202 is formed in an insulator region 212 of the substrate 200. The polysilicon cone 201 and the gate insulator 202 have been formed, in one embodiment, from a single layer of polysilicon. A gate 216 is formed on the gate insulator 202. A dielectric layer 220 is formed on the gate 216. An opaque layer 222 is formed on the dielectric layer 220.

An anode 227 opposes the cathode 201. In one embodiment, the anode is covered with light-emitting substances or compounds that are luminescent or phosphorescent.

Figure 3A:
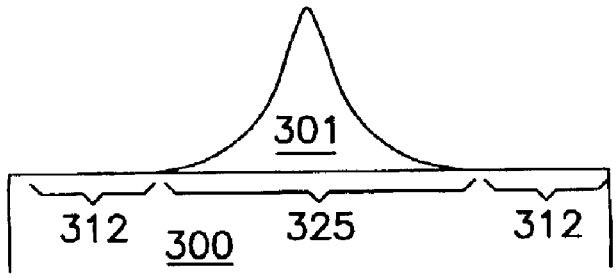
FIGS. 3A–3G are planar views of a field emitter device during various stages of fabrication according to one embodiment of the present invention.

FIGS. 3A–3G show a process of fabrication for a field emitter device according to an embodiment of the present invention. FIG. 3A shows the structure focusing on the cathode tip, after tip sharpening, following the first stages of processing. One with ordinary skill in the art would be familiar with these stages of processing.

Figure 3B:
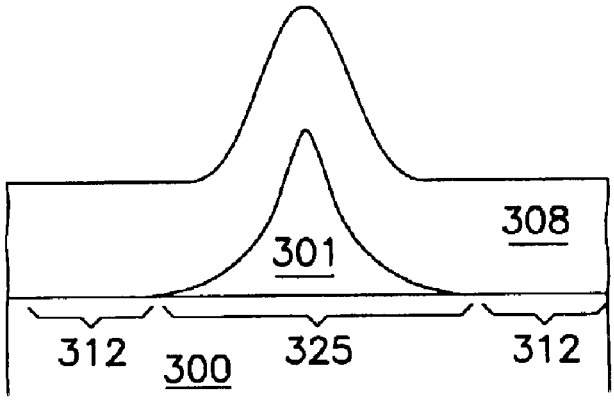

FIG. 3B shows the structure following the next sequence of processing. The insulator 308 may be referred to as a gate insulator. The insulator 308 is formed over the cathode tip 301 and the substrate 300. The regions of the insulator 308 that surround the cathode tip 301 constitute an insulator region 312 for the field emitter device.

Figure 3C:
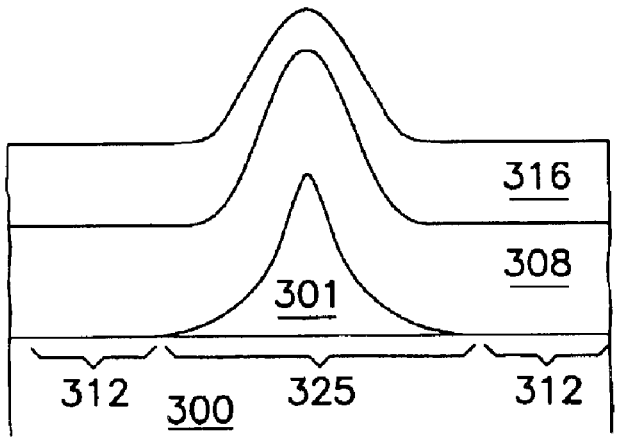

FIG. 3C shows the structure following the next stages of processing. A gate or gate layer or extraction grid 316 is formed on the insulator layer 308. The gate layer 316 includes any conductive layer material and can be formed using any suitable techniques, such as chemical vapor deposition.

Figure 3D:
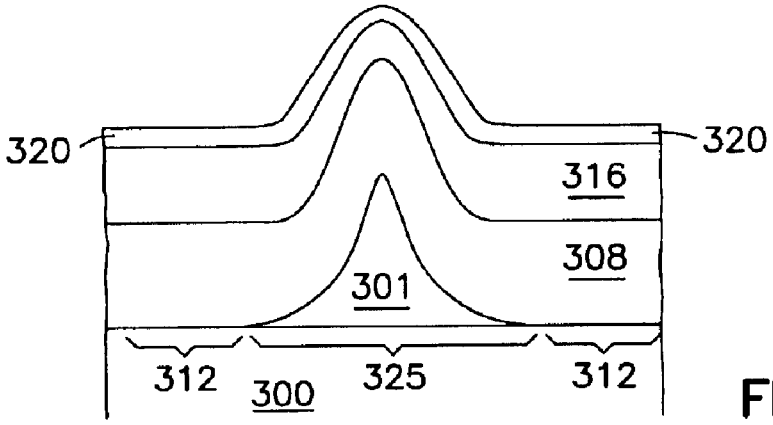

FIG. 3D shows the structure following the next stages of processing. In one embodiment, a dielectric layer 320 is formed on the gate layer 316. The dielectric layer 320 includes any non-conducting materials and can be formed using any suitable techniques, such as chemical vapor deposition. In one embodiment, the dielectric layer 320 is formed until a thickness of about 0.5 micron to about 2.0 microns is obtained. In another embodiment, this stage of forming the dielectric layer 320 is optional and may be skipped to the next stages of processing.

Figure 3E:
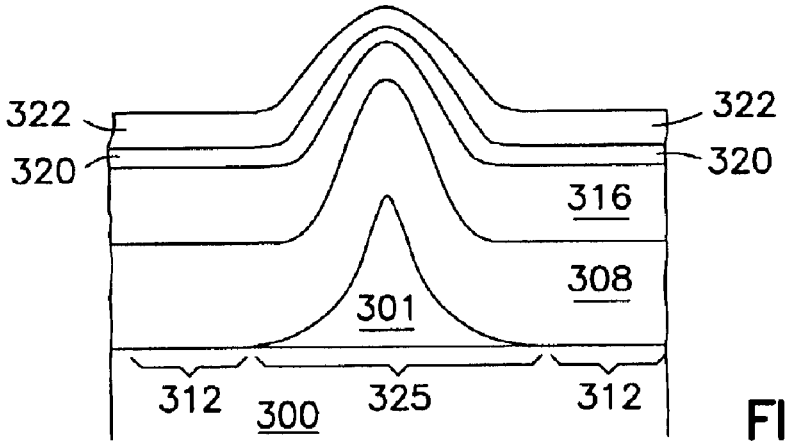

FIG. 3E shows the structure following the next stages of processing. An opaque layer 322 is formed. In one embodiment, this opaque layer is formed until a thickness of about 0.5 to about 1.0 micron is obtained. In another embodiment, the opaque layer is formed from substances, compounds, or alloys that include the following: WRe, $Ta_4B$, WN, TaW, $Ta_9Ge$, $Ta_4Re_3Ge$, TaSiN, TaSiB, and TiTa. The opaque layer 322 can be formed using any suitable techniques, such as sputtering, chemical vapor deposition process, or ion beam sputtering.

Figure 3F:
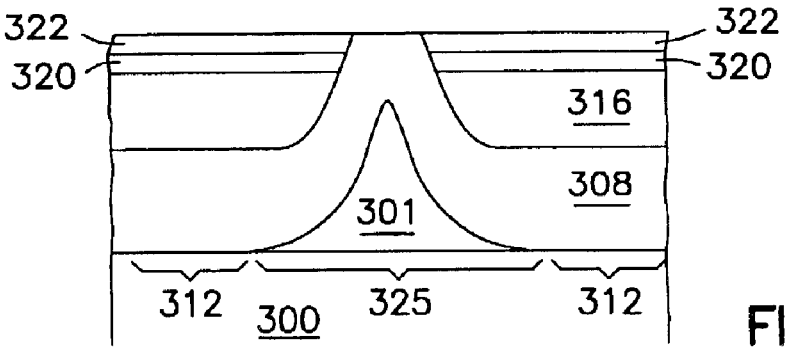

FIG. 3F shows the structure following the next stages of processing. Following deposition, the gate layer 316, the dielectric layer 320, and an opaque layer 322 undergo a removal stage. In one embodiment, these layers are removed until a portion of the insulator layer 308, covering the cathode tip 301, is revealed. Any suitable techniques may be used to accomplish this stage of processing. One exemplary technique includes chemical mechanical planarization technique.

Figure 3G:
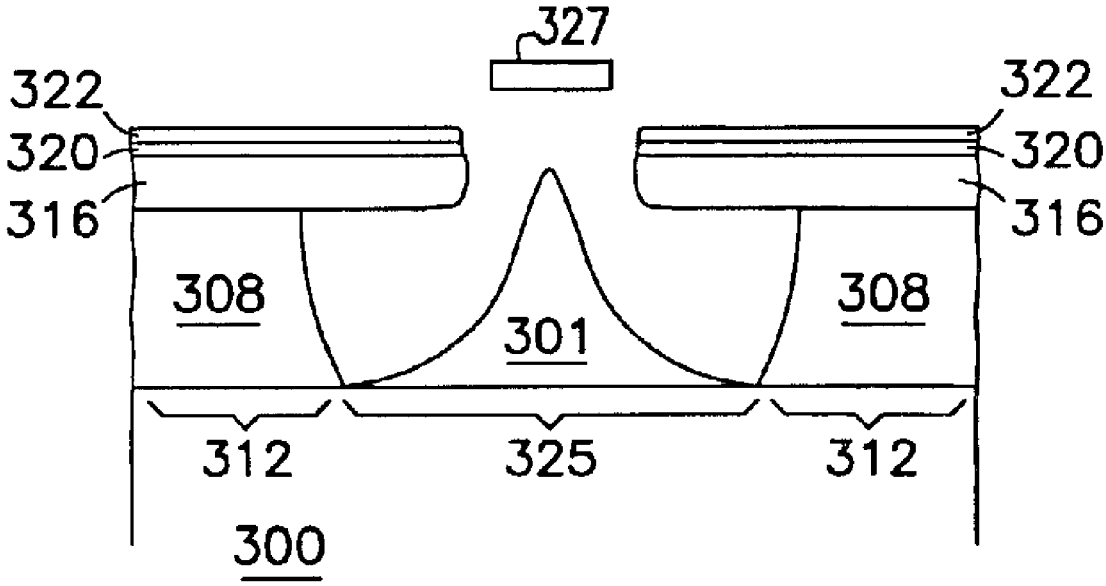

FIG. 3G shows the structure after the next sequence of processing. Here a portion of the insulator layer 308 is removed from the surrounding area of the cathode tip 301. The portion of the insulator layer 308 is removed using any suitable technique as will be understood by one of ordinary skill in the field of semiconductor processing and field emission device fabrication. One such exemplary technique includes wet etching using an isotropic solution, such as a dilute mixture of hydrofluoric acid and water.

The anode 327 is further formed opposing the cathode tip 301 in order to complete the field emission device. The formation of the anode, and completion of the field emission device structure, can be achieved in numerous ways as will be understood by those of ordinary skill in the art of semiconductor and field emission device fabrication. The formation of the anodes, and completion of the field emission device itself, do not limit the present invention and as such are not presented in full detail here.

Figure 4A:
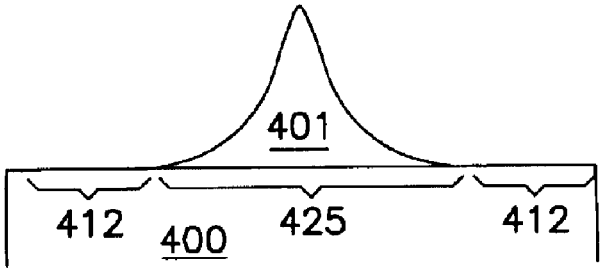
FIGS. 4A–4I are planar views of a field emitter device during various stages of fabrication according to another embodiment of the present invention.

FIGS. 4A–4J show a process of fabrication for a field emitter device according to an embodiment of the present invention. FIG. 4A shows the structure focusing on the cathode tip, after tip sharpening, following the first stages of processing. One of ordinary skill in the art would be familiar with these stages of processing.

Figure 4B:
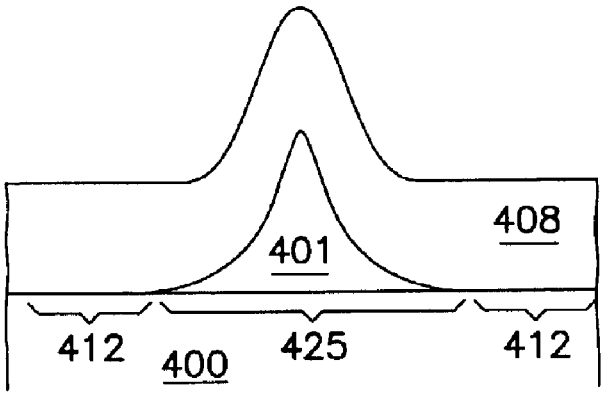

FIG. 4B shows the structure following the next sequence of processing. The insulator 408 may be referred to as a gate insulator. The insulator 408 is formed over the cathode tip 401 and the substrate 400. The regions of the insulator 408 that surround the cathode tip 401 constitute an insulator region 412 for the field emitter device.

Figure 4C:
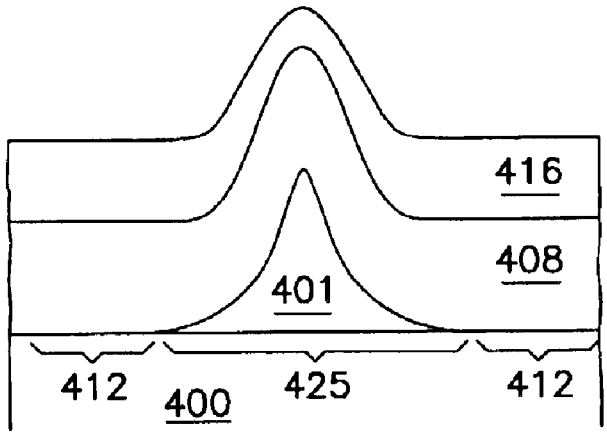

FIG. 4C shows the structure following the next stages of processing. A gate or gate layer or extraction grid 416 is formed on the insulator layer 408. The gate layer 416 includes any conductive layer material and can be formed using any suitable technique, such as chemical vapor deposition.

Figure 4D:
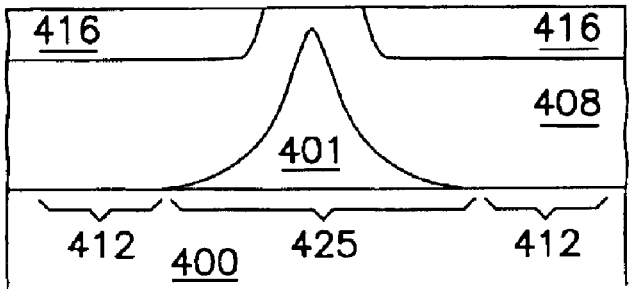

FIG. 4D shows the structure following the next stages of processing. A portion of the gate layer 416 is planarized using any suitable technique, such as chemical mechanical planarization technique. The result appears as shown in FIG. 4D.

Figure 4E:
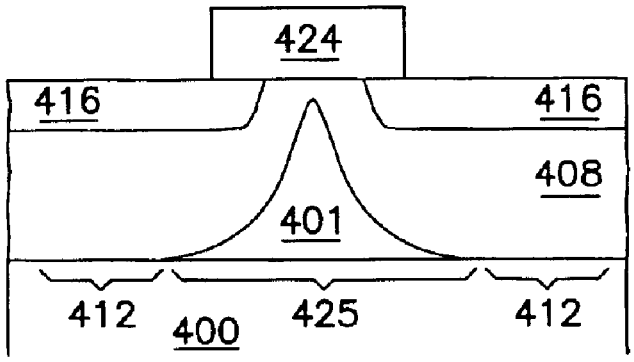

FIG. 4E shows the structure following the next stages of processing. A mask 424 is formed and situated over the cathode tip region 425. Several techniques are available to one of ordinary skill in the art to form the mask, such as a combination of using a nitride layer with a reactive ion etching technique.

Figure 4F:
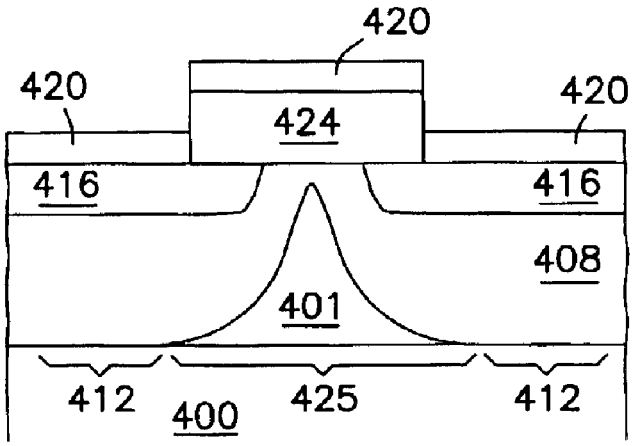

FIG. 4F shows the structure following the next stages of processing. In one embodiment, a dielectric layer 420 is formed on the gate layer 416. The dielectric layer 420 includes any non-conducting materials and can be formed using any suitable technique, such as chemical vapor deposition. In one embodiment, the dielectric layer 420 is formed until a thickness of about 0.5 micron to about 2.0 microns is obtained. In another embodiment, this stage of forming the dielectric layer 420 is optional and may be skipped to the next stages of processing.

Figure 4G:
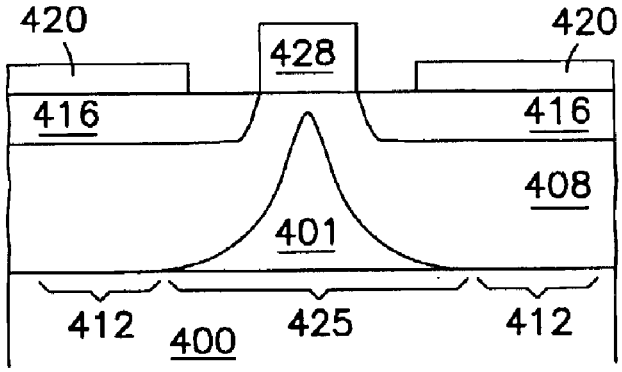

FIG. 4G shows the structure following the next stages of processing. The mask 428 is formed within the cathode region 425.

Figure 4H:
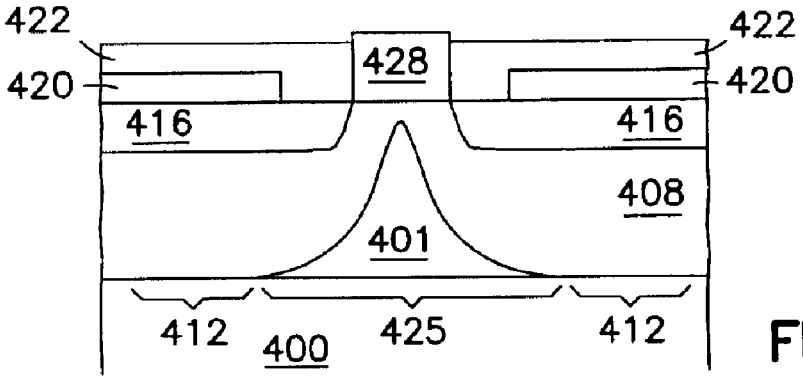

FIG. 4H shows the structure following the next stages of processing. An opaque layer 422 is formed. In one embodiment, this opaque layer is formed until a thickness of about 0.5 to about 1.0 micron is obtained. In another embodiment, the opaque layer is formed from substances, compounds, or alloys that include the following: WRe, $Ta_4B$, WN, TaW, $Ta_9Ge$, $Ta_4Re_3Ge$, TaSiN, TaSiB, and TiTa. The opaque layer 422 can be formed using any suitable technique, such as sputtering, chemical vapor deposition process, or an ion beam sputtering process.

Figure 4I:
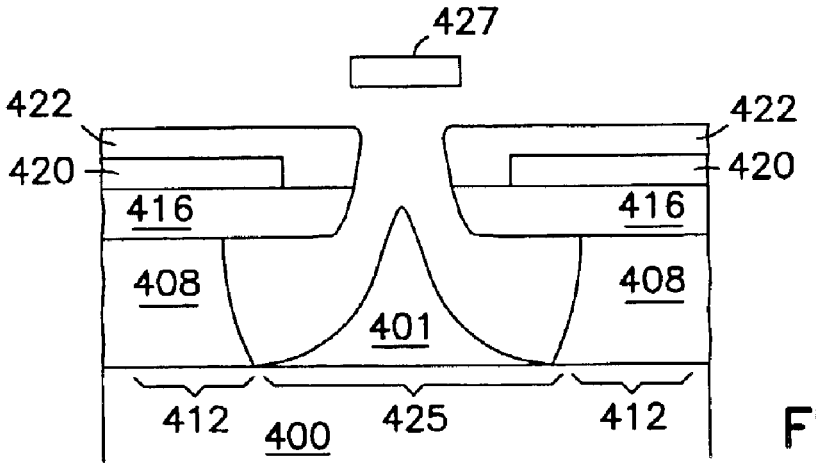

FIG. 4I shows the structure after the next sequence of processing. The reduced mask 424 is removed using any suitable technique, such as a reactive ion etching process. The removal of the mask 424 provides a lifting-off of the insulator layer 408 and exposes the cathode 401. It is well known to one of ordinary skill in the art of semiconductor processing regarding this lifting-off technique. Next, using the gate layer 416, dielectric layer 420, and opaque layer 422 as a mask, a portion of the insulator 408 is etched away from the cathode tip 401. This method of etching may be performed using any suitable technique, such as reactive ion etching.

The anode 427 is further formed opposing the cathode tip 401 in order to complete the field emission device. The formation of the anode, and completion of the field emission device structure, can be achieved in numerous ways as will be understood by those of ordinary skill in the art of semiconductor and field emission device fabrication. The formation of the anodes, and completion of the field emission device itself, do not limit the present invention and as such are not presented in full detail here.

Figure 5:
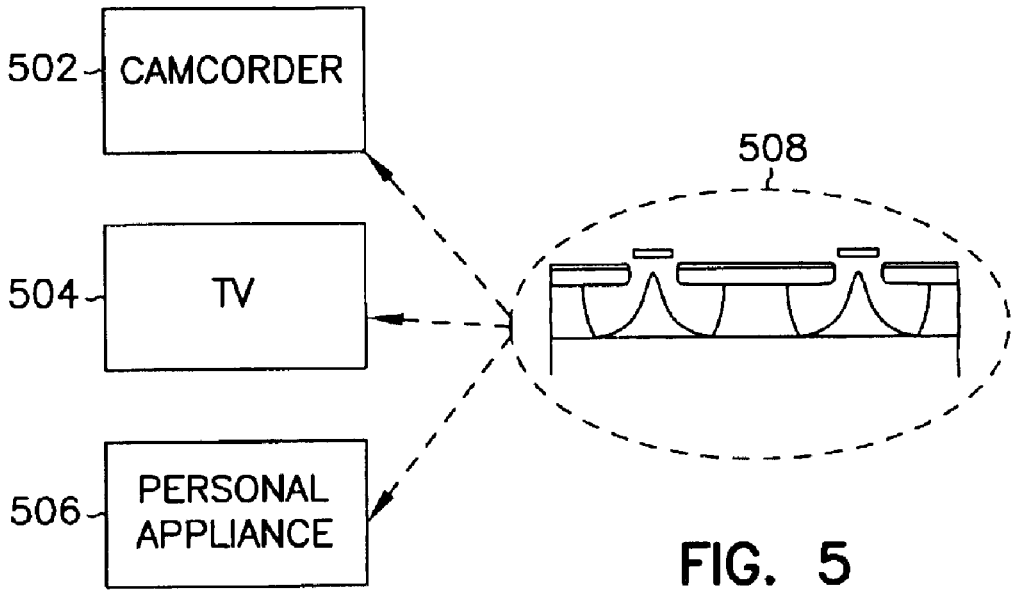
FIG. 5 illustrates a sample of commercial products using a video display according to one embodiment of the present invention.

FIG. 5 shows exemplary video display products using an array of field emitter devices 508 in accordance with an embodiment of the present invention. The array of field emitter devices 508 are described and presented above in connection with the above figures. In one embodiment, the video display product is a camcorder 502; the camcorder 502 includes a camcorder viewfinder incorporating an array of field emitter devices. In another embodiment, the video display product is a flat-screen television 504 incorporating an array of field emitter devices. In a further embodiment, the video display product is a personal appliance 506 incorporating an array of field emitter devices. In all embodiments, the video display product includes a display screen for showing a video image.

Figure 6:
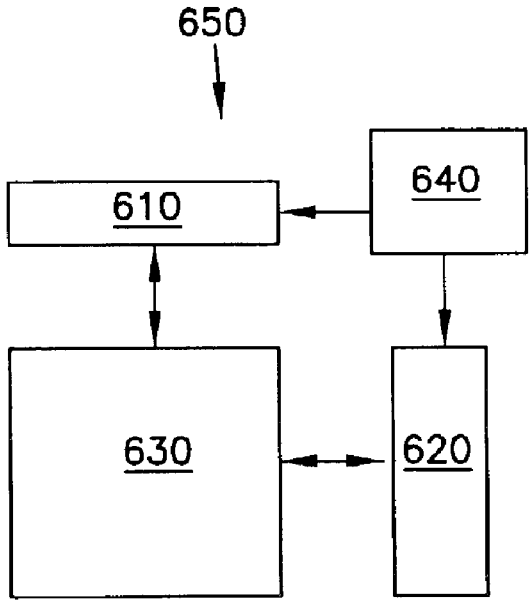
FIG. 6 is a block diagram that illustrates a flat panel display system according to one embodiment of the present invention.

FIG. 6 is a block diagram that illustrates an embodiment of a flat panel display system 650 according to an embodiment of the present invention. A flat panel display includes a field emitter array formed on a glass substrate. The field emitter array includes a field emitter array 630 as described and presented above in connection with the above figures. A row decoder 620 and a column decoder 610 each couple to the field emitter array 630 in order to selectively access the array. Further, a processor 640 is included which is adapted to receiving input signals and providing the input signals to address the row and column decoders 620 and 610. In one embodiment, the processor 640 includes a memory (not shown). This memory includes random access memories (RAM), such as dynamic RAM or video RAM.

Conclusion

Thus, structures and methods have been described for shielding radiation in field emitter devices. A field emitter device using the described concept benefits from having superior reliability because of its ability to block high-energy radiation in the vicinity of the field emitter device. Having a low rate of failure due to superior reliability may contribute to consumers' acceptance of the device, and thus, the success of these field emitter devices in the marketplace.

Structures and methods are provided for shielding field emitter devices from radiation. In one exemplary embodiment, a shielding layer inhibits radiation from degrading field emitter devices while exerting a predetermined force upon the field emitter devices so as to restrain from damaging the structure of the devices or affect the devices' electronic or electrical performance. In another exemplary embodiment, the field emitter under the protection of the shielding layer is capable of sustaining structural equilibrium. In yet another embodiment, the field emitter is capable of sustaining structural elasticity. In a further embodiment, the shielding layer may be comprised of tetratantalum boride; this compound inhibits radiation from degrading field emitter devices while exerting a predetermined force upon the field emitter devices so as to restrain from damaging the structure of the devices or affect the devices' electronic or electrical performance; in another embodiment, the field emitter under the protection of the tetratantalum boride layer is capable of sustaining structural equilibrium; in another embodiment, the field emitter is capable of sustaining structural elasticity under the protection of the tetratantalum boride layer.

Although the specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments and other embodiments will be apparent to those of skill in the art upon reviewing the above description. The scope of the invention includes any other applications in which the above structures and fabrication methods are used. Accordingly, the scope of the invention should only be determined with reference to the appended claims, along with the full scope of equivalents to which such claims are entitled.

What is claimed is:

1. A method of forming a field emission device, comprising:

forming a cathode emitter tip on a substrate;

forming an extraction grid;

forming a dielectric layer on the cathode emitter tip and the substrate;

forming an opaque layer having a thickness of about 0.5 micron to about 1.0 micron; and forming an anode opposite the cathode emitter tip.

2. The method of claim 1, wherein forming the opaque layer comprises forming the opaque layer from a material selected from a group consisting of WRe, $Ta_4B$, WN, TaW, $Ta_9Ge$, $Ta_4Re_3Ge$, TaSiN, TaSiB, and TiTa.

3. The method of claim 1, wherein forming the dielectric layer comprises forming a dielectric layer thickness of about 0.5 micron to 2.0 microns.

4. The method of claim 1, wherein forming the opaque layer comprises forming through a process selected from a group consisting of a sputtering process, a chemical vapor deposition process, and an ion beam sputtering process.

5. A method of forming a field emission device, comprising:

forming a cathode emitter tip on a substrate;

forming an extraction grid;

forming a dielectric layer; and forming an opaque layer having a thickness of about 0.5 micron to 1.0 micron.

6. The method of claim 5, wherein forming the opaque layer comprises forming the opaque layer from a material selected from a group consisting of WRe, $Ta_4B$, WN, TaW, $Ta_9Ge$, $Ta_4Re_3Ge$, TaSiN, TaSiB, and TiTa.

7. The method of claim 5, wherein forming the dielectric layer comprises forming a dielectric layer thickness of about 0.5 micron to 2.0 microns.

8. The method of claim 5, wherein forming the opaque layer comprises forming through using a process selected from a group consisting of a sputtering process, a chemical vapor deposition, and an ion beam sputtering process.

9. A method of forming a field emission device, comprising:

forming a cathode emitter tip on a substrate;

forming an extraction grid;

forming a dielectric layer; and forming an opaque layer comprising a material selected from a group consisting of WRe, $Ta_4B$, WN, TaW, $Ta_9Ge$, $Ta_4Re_3Ge$, TaSiN, TaSiB, and TiTa.

10. The method of claim 9, wherein forming the opaque layer comprises forming an opaque layer thickness of about 0.5 micron to 1.0 micron.

11. The method of claim 9, wherein forming the opaque layer comprises forming through using a sputtering process.

12. The method of claim 9, wherein forming the opaque layer comprises forming through using a chemical vapor deposition process.

13. The method of claim 9, wherein forming the opaque layer comprises forming through using an ion beam sputtering process.

14. A method of forming a field emission device, comprising:

forming a cathode emitter tip on a substrate;

forming an extraction grid;

forming a dielectric layer with a thickness of about 0.5 micron to 2.0 microns; and forming an opaque layer having a thickness of about 0.5 micron to 1.0 micron.

15. The method of claim 14, wherein forming the opaque layer comprises forming the opaque layer from a material selected from a group consisting of WRe, $Ta_4B$, WN, TaW, $Ta_9Ge$, $Ta_4Re_3Ge$, TaSiN, TaSiB, and TiTa.

16. The method of claim 14, wherein forming the opaque layer comprises forming through a process selected from a group consisting of a sputtering process, a chemical vapor deposition process, and an ion beam sputtering process.

17. A method of forming a field emission device, comprising:

forming a cathode emitter tip on a substrate;

forming an extraction grid;

forming a dielectric layer with a thickness of about 0.5 micron to 2.0 microns; and forming an opaque layer comprising a material selected from a group consisting of WRe, $Ta_4B$, WN, TaW, $Ta_9Ge$, $Ta_4Re_3Ge$, TaSiN, TaSiB, and TiTa.

18. A method of forming a field emission device, comprising:

forming a cathode emitter tip on a substrate;

forming an extraction grid; and forming an opaque layer comprising a material selected from a group consisting of WRe, $Ta_4B$, WN, TaW, $Ta_9Ge$, $Ta_4Re_3Ge$, TaSiN, TaSiB, and TiTa.

19. A method, comprising:

forming at least one emitter adapted to emit electrons at a desired level of energy; and forming a tetratantalum boride opaque layer.

20. The method of claim 19, wherein forming the tetratantalum boride opaque layer comprises forming an tetratantalum boride opaque layer thickness of about 0.5 micron to 1.0 micron.

21. A method, comprising:

forming at least one emitter adapted to emit electrons at a desired level of energy; and forming an opaque layer comprising a material selected from a group consisting of WRe, $Ta_4B$, WN, TaW, $Ta_9Ge$, $Ta_4Re_3Ge$, TaSiN, TaSiB, and TiTa.

22. The method of claim 21, wherein forming the opaque layer comprises forming an opaque layer thickness of about 0.5 micron to 1.0 micron.

23. A method of improving structural stability of a field emitter display device, comprising:

forming at least one emitter adapted to emit electrons at a desired level of energy;

forming a shielding layer to inhibit radiation degradation of the emitter; and resisting stress in the emitter given the presence of the shielding layer so as to sustain structural stability.

24. The method of claim 23, wherein resisting stress includes resisting tensile stress.

25. The method of claim 23, wherein forming the shielding layer comprises forming a shielding layer to shield radiation with wavelengths in a range of greater than about 0.01 Angstroms to less than about 100 Angstroms.

26. The method of claim 25, wherein resisting stress includes resisting tensile stress.

27. The method of claim 23, wherein resisting stress includes resisting shear stress.

28. The method of claim 23, wherein forming the shielding layer comprises forming a shielding layer to shield radiation with wavelengths in a range of greater than about 0.01 Angstroms to less than about 100 Angstroms.

29. The method of claim 28, wherein resisting stress includes resisting shear stress.

30. The method of claim 23, wherein resisting stress includes resisting volume stress.

31. The method of claim 23, wherein forming the shielding layer comprises forming a shielding layer to shield radiation with wavelengths in a range of greater than about 0.01 Angstroms to less than about 100 Angstroms.

32. The method of claim 31, wherein resisting stress includes resisting volume stress.

33. The method of claim 23, wherein resisting stress includes resisting at least one of tensile stress, shear stress, and volume stress.

34. A method, comprising:

forming at least one emitter adapted to emit electrons at a desired level of energy;

forming a shielding layer with a predetermined thickness from a material with a high atomic number to inhibit hard x-ray degradation of the emitter; and exerting a predetermined quantity of force from the shielding layer to other semiconductor structure so as to sustain structural stability.

35. A method, comprising:

forming at least one emitter adapted to emit electrons at a desired level of energy;

forming a light-emitting target that radiates when the emitted electrons strike the light-emitting target;

forming a shielding layer with a predetermined thickness from a material with a high atomic number to inhibit hard x-ray degradation of the emitter; and exerting a predetermined quantity of force from the shielding layer to other semiconductor structure so as to sustain structural stability.

36. The method of claim 35, wherein forming the light-emitting target includes coating the light-emitting target with luminescent matter.

37. The method of claim 35, wherein forming the light-emitting target includes coating the light-emitting target with phosphorescent matter.

38. A method, comprising:

inputting signals into a processor;

outputting a display signal from the processor;

providing a display from at least one field emission device; and inhibiting radiation degradation of the field emission device; and resisting stress in the at least one field emission device so as to sustain structural stability.

39. The method of claim 38, wherein outputting a display signal includes storing the display signal in a memory.

40. The method of claim 39, wherein providing a display includes sending the display signal from the memory to the field emission device.

41. A method, comprising:

inputting signals into a processor;

outputting a display signal from the processor;

providing a display from at least one field emission device; and shielding radiation from the field emission device to inhibit radiation degradation; and resisting stress in the at least one field emission device so as to sustain structural stability.

42. The method of claim 41, wherein outputting a display signal includes storing the display signal in a memory.

43. The method of claim 42, wherein providing a display includes sending the display signal from the memory to the field emission device.

44. A method, comprising:

inputting signals into a processor;

outputting a display signal from the processor;

providing a display from at least one field emission device; and resisting stress in the field emission device so as to sustain structural stability.

45. The method of claim 44, wherein resisting stress includes comprises providing a shielding layer to shield radiation with wavelengths in a range of greater than about 0.01 Angstroms to less than about 100 Angstroms.

46. The method of claim 44, wherein resisting stress includes resisting at least one of tensile stress, shear stress, and volume stress.

47. A method of forming a field emission device, comprising:

forming a cathode emitter tip on a substrate;

forming an extraction grid;

forming a dielectric layer on the cathode emitter tip and the substrate;

forming an opaque layer having a thickness of about 0.5 micron to about 1.0 micron, wherein forming an opaque layer includes forming a tetratantalum boride layer; and forming an anode opposite the cathode emitter tip.

48. A method of forming a field emission device, comprising:

forming a cathode emitter tip on a substrate;

forming an extraction grid;

forming a dielectric layer on the cathode emitter tip and the substrate;

forming an opaque layer having a thickness of about 0.5 micron to about 1.0 micron, wherein forming an opaque layer includes resisting stress in the cathode emitter tip; and forming an anode opposite the cathode emitter tip.

49. A method of forming a field emission device, comprising:

forming a cathode emitter tip on a substrate;

forming an extraction grid;

forming a dielectric layer; and forming an opaque layer having a thickness of about 0.5 micron to 1.0 micron, wherein forming an opaque layer includes forming a tetratantalum boride layer.

50. A method of forming a field emission device, comprising:

forming a cathode emitter tip on a substrate;

forming an extraction grid;

forming a dielectric layer; and forming an opaque layer having a thickness of about 0.5 micron to 1.0 micron, wherein forming an opaque layer includes resisting stress in the cathode emitter tip.

51. A method of forming a field emission device, comprising:

forming a cathode emitter tip on a substrate;

forming an extraction grid;

forming a dielectric layer with a thickness of about 0.5 micron to 2.0 microns; and forming an opaque layer having a thickness of about 0.5 micron to 1.0 micron, wherein forming the opaque layer comprises forming the opaque layer from a material selected from a group consisting of WRe, $Ta_4B$, WN, TaW, $Ta_9Ge$, $Ta_4Re_3Ge$, TaSiN, TaSiB, and TiTa, and wherein forming an opaque layer includes resisting stress in the cathode emitter tip.

52. A method of forming a field emission device, comprising:

forming a cathode emitter tip on a substrate;

forming an extraction grid; and forming an opaque layer comprising a material selected from a group consisting of WRe, $Ta_4B$, WN, TaW, $Ta_9Ge$, $Ta_4Re_3Ge$, TaSiN, TaSiB, and TiTa, and wherein forming an opaque layer includes resisting stress in the cathode emitter tip.

* * * * *